United States Patent [19]

Kicherer et al.

[11] Patent Number: 4,931,620

[45] Date of Patent: Jun. 5, 1990

[54] ELECTRIC HOTPLATE

[75] Inventors: Robert Kicherer; Felix Schreder, both of Oberderdingen, Fed. Rep. of Germany

[73] Assignee: E.G.O. Elektro-Gerate Blanc u. Fischer, Fed. Rep. of Germany

[21] Appl. No.: 239,136

[22] Filed: Aug. 31, 1988

[30] Foreign Application Priority Data

Sep. 5, 1987 [DE] Fed. Rep. of Germany ... 8712088[U]

[51] Int. Cl.[5] ..... H05B 3/70

[52] U.S. Cl. ..... 219/463; 219/457; 219/467

[58] Field of Search ..... 219/463, 457, 458, 459, 219/460, 461, 462, 467

[56] References Cited

U.S. PATENT DOCUMENTS

| | | | |
|---|---|---|---|
| 1,344,282 | 6/1920 | Wassell | 219/459 |
| 2,177,173 | 10/1939 | Dadson | 219/463 |
| 2,325,358 | 7/1943 | Andrews | 219/ |
| 2,422,057 | 6/1947 | Weinhardt | 219/459 |
| 4,414,466 | 11/1983 | Fischer | 219/458 |

FOREIGN PATENT DOCUMENTS

| | | | |
|---|---|---|---|
| 196981 | 4/1958 | Austria | 219/461 |
| 692301 | 6/1940 | Fed. Rep. of Germany . | |
| 2442717 | 3/1976 | Fed. Rep. of Germany | 219/449 |
| 2933349 | 3/1981 | Fed. Rep. of Germany . | |
| 3514083 | 11/1985 | Fed. Rep. of Germany . | |
| 53905 | 1/1947 | France | 219/460 |
| 924450 | 8/1947 | France | 219/457 |

*Primary Examiner*—Teresa J. Walberg

*Attorney, Agent, or Firm*—Steele, Gould & Fried

[57] ABSTRACT

In an electric hotplate (1), the hotplate body (4) has a throughbore (28) located in its central axis (10) and traversing a central stud (7) and the top surface and in which can be arranged in countersunk manner the head (26) of a fastening bolt (25) projecting over the underside of central stud (7). On the underside of the hotplate (1) is provided for the electrical connection thereof a connecting piece (16) of an electrical snap closure coupling (20), so that hotplate (1) in simple manner and with limited tool expenditure permits a rapid assembly from the top of a mounting plate (2) and, if necessary, can also be rapidly replaced.

21 Claims, 3 Drawing Sheets

ELECTRIC HOTPLATE

BACKGROUND OF THE INVENTION

1. Field of the Invention

The present invention relates to an electric hotplate having a hotplate body, at least one heating resistor, terminals for electrically connecting said heating resistors and means for mounting in a hob or a similar mounting plate.

2. Prior Art

Electric hotplates of this general type can be used, for example, for arrangement on a table plate in the manner of a built-in cooker or as a cover plate of a cooker casing. Usually, prior to the fitting of the mounting or built-in plate, the hotplates are locked to the carrier or support provided for the built-in plate from the bottom of the latter, or are locked to the top thereof in such a way that clamp bolts can be screwed in from the underside into a central stud. This construction does not permit the fitting of the hotplate from the top of the built-in plate, so that a rapid replacement of the hotplate is not possible, because firstly the built-in plate must be disassembled or rendered accessible from the bottom.

SUMMARY OF THE INVENTION

An object of the present invention is to provide an electric hotplate of the aforementioned type, which in simple manner and with limited expenditure on tools permits a rapid fitting from the top of the built-in plate and also permits rapid replacement.

According to the invention this object is achieved in the case of an electrilc hotplate of the aforementioned type by effecting the mounting as well as the electrical connecting of the hotplate from the top side. Through a fast-action snap closure coupling the electric terminal coupling for the hotplate can be easily made from the top of the built-in plate, namely through the opening thereof, if the terminal connections are formed by spot welding or screw connections. Despite their inherent rigidity, the leads can be formed by at least one helically curved portion so as to be flexible or longitudinally extendable in such a way that their connecting ends for connection to the hotplate terminals can be brought into roughly the vicinity of the plate opening or through the same to the top of the built-in plate and consequently are very easily accessible for forming the connections. The connecting ends of the leads can also be combined to a plug, which is appropriately so fixed to the bottom of the mounting plate, the simultaneously inserting the hotplate in the plate opening the electrically conducting plug connections with the connecting piece of the hotplate are installed. After installing the electrical terminal connections between the terminals and the leads, the fastening bolt can be operated from the top for locking the hotplate relative to the mounting plate.

Despite the fastening bolt passing through the hotplate body it is possible to secure a lower cover plate of the hotplate body substantially directly will respect to the central plug. Although a securing member engaging in the outer circumference of the central plug or stud would be conceivable, instead of this it is possible to use a member engaging from the lower end of the central stud into its inner circumference, particularly into an inner profiling, such as an inner thread and having a passage for the fastening bolt, which can be so simultaneously adapted to the inner circumference of the securing member that it secures the same radially against detachment from the engagement position. Although conceivable, if the securing member is not made in one-part manner with the cover plate and is instead shaped from the same, it is appropriately formed by a sleeve-like collar in such a way that its passage can be so closely adapted to the external diameter of the fastening bolt, that it is centered via the securing member with respect to the central stud and therefore with respect to the hotplate body. In place of a threaded connection between the securing member and the central stud, it is also adantageous to use a connection including, for example claw-like, resilient members springing into engagement.

It is also possible to provide a similar connection between the fastening bolt end projecting over the lower end of the central stud and a counter-member, by means of which the fastening bolt is supported with respect to the bottom of the mounting plate. For such a connection, e.g., a high-speed lock nut would be conceivable, so that for locking the hotplate the fastening bolt would either not or at the most only have to be turned one to a few times and a turning of the fastening bolt would in particular only be necessary for loosening the hotplate.

The inventive construction is particularly suitable for those hotplates which have a hotplate body made from a cast material with an external flange edge projecting at the underside and an inner flange edge projecting to a lesser extent beyond the underside and which spacedly surrounds the central plug. Between the inner and the outer flange edge in the underside of the hotplate body is provided at least one spiral slot, in which is embedded at least one helical heating resistor in a compressed insulating material. The substantially planar cooking surface is appropriately circular in such a way that the hotplate body is centrally provided on the associated side, namely within the innermost spiral turn of the heating resistors with a countersunk unheated zone, in which is located the fastening bolt head. The top or the vicinity of the cooking surface of the hotplate body is completely closed except for the passage bore located on the top of the hotplate body and completely closed in the assembled state by the fastening bolt or by its head.

These and other features of preferred developments of the invention can be gathered from the claims, description and drawings and the individual features can be realized in an embodiment of the invention and in other fields either singly or in the form of subcombinations and represent advantageous constructions for which protection is hereby claimed.

BRIEF DESCRIPTION OF THE DRAWINGS

Embodiments of the invention are shown in the drawings, namely.

DETAILED DESCRIPTION OF THE PREFERRED EMBODIMENTS

Figure 1:
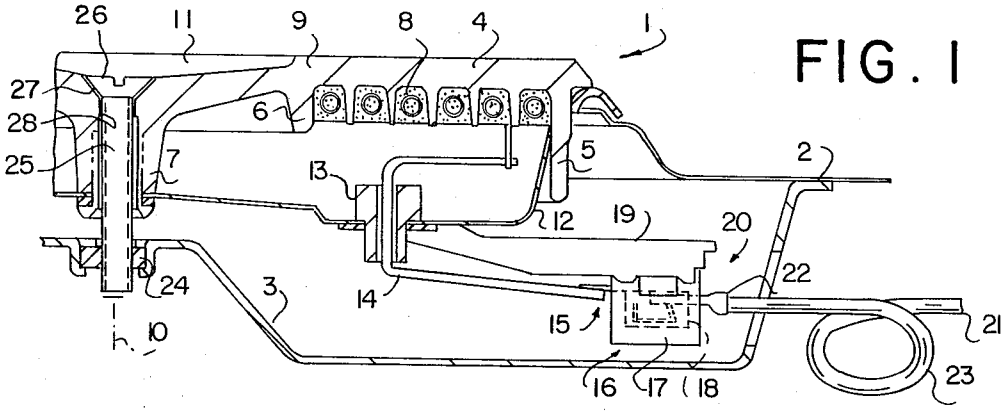
FIG. 1; A detail of an inventive, fitted and electrically connected electric hotplate 1 in axial section.

The inventive electric hotplate 1 is intended for installation in a built-in or mounting plate 2 made from stainless steel and, e.g., constructed as a profile plate, which appropriately receives two or more adjacent hotplates of different size and/or power ratings and in the vicinity of the particular hotplate 1 is deformed to a hump-like protuberance, in which is provided a plate opening for inserting hotplate 1. On the underside of the hotplate 1 passing through the mounting plate 2 and on the underside of the latter is provided at least one strap or lid-like holding part, which is used for securing the hotplate 1 in such a way that adjacent to the boundary of the plate opening it engages on the top of the protuberance of mounting plate 2 under tension and with a profile ring, which projects over the outer cirucumference of the body 4 of hotplate 1 and forms the visible circumferential boundary of said hotplate 1.

The cast material hotplate body 4 which, in plan view may be rounded circular, rectangular or square or the like, has an annular flange edge 5 projecting on the underside and with limited radial spacing from its outer circumference and to whose outer circumference the profile ring is fixed close to the top of the hotplate body 4 in such a way that it is supported on a ring shoulder of body 4 projecting over its outer circumference. With radial spacing within and concentric to the outer flange edge 5 is provided an inner flange edge 6, which does not project downwards farther than flange edge 5. Once again in radially spaced manner within said inner flange edge 6 is provided a central stud 7 of hotplate body 4, projecting downwards by roughly the same amount as the outer flange edge 5 and equiaxial with the latter.

In the underside of the hotplate body 4 and between flange edges 5 and 6 is provided at least one spiral slot and in the latter is arranged an elongated heating resistor 8 formed by a wire coil embedded in a compressed insulating material. The top of hotplate body 4 forms an annular, planar cooking surface 9 equiaxial to the central axis 10 of hotplate body 4 and extending approximately to the outer circumference of the latter and whose inner circumference roughly corresponds to the width of the inner flange edge 6. Within said cooking surface 9 or the heating resistor or resistors 8, i.e. in the unheated area, the hotplate body 4 is provided on the top with a flat depression 11 becoming slightly deeper towards its center.

The underside of the hotplate body 4 is closed by a cover plate 12 formed by a deep-drawn sheet metal part or the like and which can be connected to the lower end face of the outer flange edge 5 or, as shown, to its inner circumference and is axially secured by a fastening connection with the central stud 7 with respect to the hotplate body 4.

Between the two flange rings 5, 6 the cover plate 12 is traversed by a ceramic material insulating sleeve 13 fixed thereto and which is traversed by passage openings for two or more juxtaposed connecting leads 14, whose inner ends are connected to terminal pins of the heating resistor or resistors 8. The outer ends of the connecting leads 14, bent directly below the insulating sleeve 13 towards the outer circumference of the hotplate body 4, form a corresponding number of terminals 15 for the electrically conducting connection of the heating resistor or resistors 8 of hotplate 1. Although conceivable, in the represented embodiment terminals 15 do not form freely projecting individual terminals but are electrically conductively connected, e.g. by spot welding to a connecting pilece 16, which forms a common plug part for all the terminals 15.

In an insulating body 17 made from a ceramic material, e.g. steatite, connecting piece 16 has bushes 18, whereof in each case one is connected by means of a connecting lug to an associated terminal 15 and which are spaced from one another, their plug openings being provided on the side of the connecting piece 16 remote from the central axis 10. The outer, inherently rigid ends of the connecting leads 14 can form a support arm for the positionally stable mounting of the connecting piece 16. A particularly reliable mounting of the connecting piece 16 is, however, obtained instead of this or in addition thereto by a support arm 19, which is fixed in the vicinity of the insulating sleeve 13 to the bottom of the cover plate 12 and from said fastening point projects outwards approximately radially to central axis 10. The support arm 19, e.g. formed by a sheet metal section engages around the insulating body 17 of connecting piece 16 from the top, so that the latter is secured in suspended manner on the outer end of the support arm 19 positioned above terminals 15 and in plan view is located outside the outer circumference of the remaining hotplate 1.

Connecting piece 16 forms a plug part of a snap closure coupling 20 by means of which the terminals 15 of hotplate 1 can be electrically conductively connected with the matching plug or plugs 22 of a corresponding number of connecting lines 21, which for power control purposes connect the heating resistors 8 to a manually operable switch. The connecting lines 12 can also be inherently rigid lines appropriately, insulated by braided sheaths, and have extended portions 23 making it possible to elastically and resiliently extend the leads lengthwise, so that the mating plugs 22 can be drawn at least into the vicinity of the opening of mounting plate 2. Th extended portions 23 can e.g. be in each case formed by at least one loop-like or helically curved length portion of the connecting line 21. In the represented emboidment each connecting line 21 has a separate mating plug 22 not directly connected to the remaining connecting lines and which can e.g. be formed by a multicore cable end and is adapted to engage the associated bush 18 of the connecting piece 16.

The cover-like holding part 3 is located with an outer, circular, planar portion of its bottom at a limited distance below the connecting piece 16 which, including the support arm 19, is entirely located within the holding part 3 and extends from the inside to close to its circumferential casing. The latter is provided with an opening for the passage of connecting line 21 or the completely internally located mating plug 22. The circumferential casing at the upper end passes into an outwardly directed, ring disk-shaped channel with which the holding part 3 is supported on the bottom of the mounting plate 2 radially outside the protuberance. In the center the bottom has a dome-like protuberance for locking with respect to the central stud 7.

Holding part 3 has a cage shaped out of it for the axially secured reception of a countermember 24 located in the central axis 10 and in the form of a threaded nut, which is internally spaced below the hotplate 1 and is used for the engagement of a fastening bolt 25 passing through the hotplate body 4 in central stud 7 and whose frustum-shaped head 26, constructed as a slotted head, is countersunk with respect to the cooking surface 9 and terminates flush with the bottom surface of depression 11 in such a way that it is accessible from the top of hotplate 1 for receiving a tool, such as a screwdriver. Head 26 is located in a portion of a throughbore 28 counstructed as a countersunk hole and which passes through the central stud 7 from the top of the hotplate body 4 to the lower end of central stud 7 and whose diameter is relatively closely adapted to the external diameter of the threaded shank of the fastening bolt 25.

Figure 2:
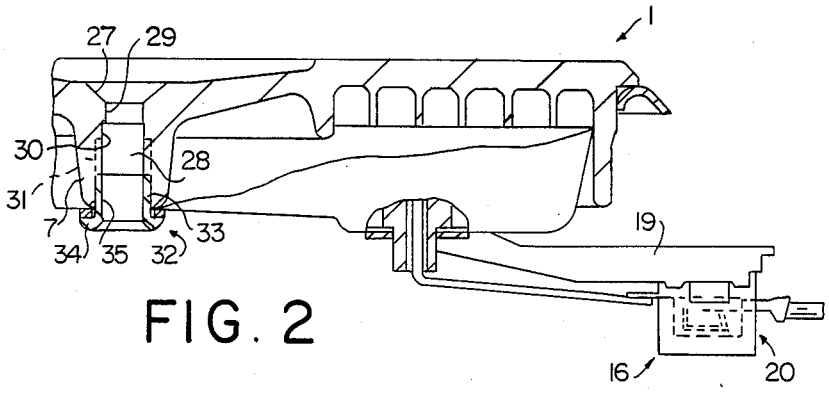
FIG. 2: The hotplate according to FIG. 1, but not in the fitted state and shown in simplified form.

As can in particular be gathered from FIG. 2, the throughbore 28 has a relatively short bore portion 29 directly connected to the countersunk hole 27 and which is adapted with a small radial clearance closely to the outer diameter of the shank of the fastening bolt 25 and to which is connected at the bottom a slightly wider bore portion 30, which extends to the lower end of the central stud 7. On part of its length extending to its lower end said bore portion 30 is provided with an inner profiling 31 in the form of an internal thread.

Into said internal thread is screwed a sleeve part 33 of a securing sleeve 32 having a corresponding external thread and which traverses a throughbore in the bottom of the cover plate 12 and locks the same with a collar 34 provided at its lower end and optionally accompanied by the interposing of a washer against the lower end face of central stud 7. The external diameter of collar 34 roughly corresponds to the external diameter of the lower end of central stud 7, so that the securing sleeve 32 substantially forms a detachable lower extension of central stud 7. Bore 35, widened at the lower end, of securing sleeve 32 is adapted in substantially the same way as bore portion 29 to the shank of the fastening bolt 25 and extends only over a lower part of the length of bore portion 30.

For fitting purposes the hotplate 1 can be brought from above onto the mounting plate 2 in the use position and then can be electrically connected in the vicinity of its plate opening to the connecting lines 21 with the aid of the snap closure coupling 20. The hotplate body 4 is then inserted in the plate opening and the fastening bolt 25 is screwed into the counter-member 24 of the holding part 3; positionally secured with respect to the mounting plate 2, until an adequate fixing action is obtained. The hotplate 1 can be correspondingly simply disassembled or replaced by another hotplate, which e.g. has a different rated capacity, but the same size. Through the engagement of support arm 19 in the opening or cutout of the holding part 3, it is also possible to prevent rotation of hotplate 1 relative to mounting plate 2 with respect to the rotation about its central axis 10.

In FIGS. 3 to 6 corresponding parts are given the same reference numerals as in the other drawings, but are followed by different reference letters.

Figure 3:
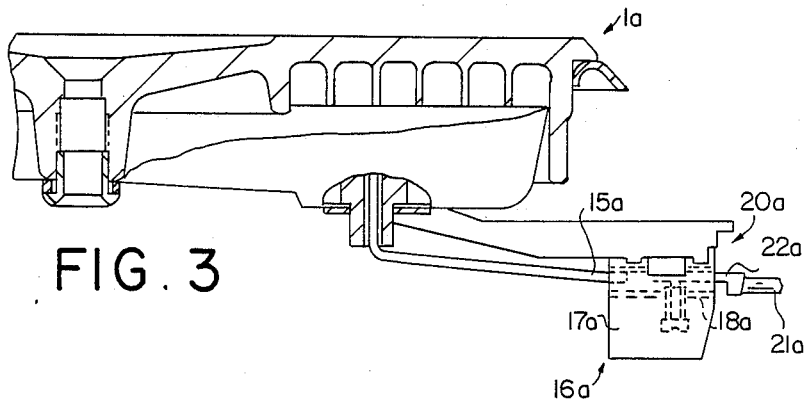
FIG. 3: Another embodiment in a representation corresponding to FIG. 2.

Whereas in the embodiment according to FIGS. 1 and 2 the bushes 18 of connecting piece 16 are constructed as barb-like, interclawing locking bushes, the plug connections **18*a* in the embodiment according to FIG. 3 are constructed as screw bushes, which in each case have at least one locking screw for fixing the inserted mating plug 22*a* of the connecting lines 21*a*. The terminals 15*a* can also be fixed in each case by a locking screw or the like, so that the connecting piece 16*a* can be removed from hotplate 1*a*** as a separate component.

Figure 4:
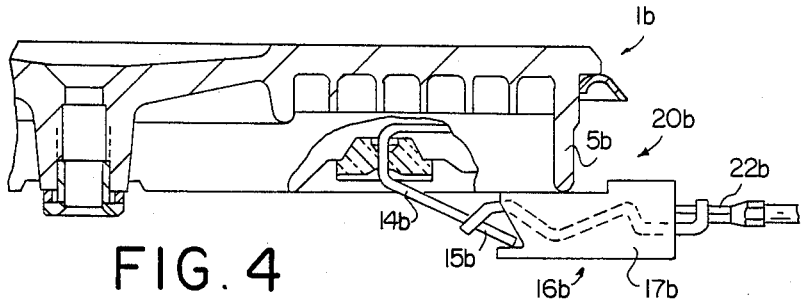
FIG. 4: Another embodiment is a representation corresponding to FIG. 2.

In the embodiment according to FIG. 4 the coupling **20*b* has a connecting piece 16*b*, whose lead passing through the insulating body 17*b* can be connected by spot welding or the like to the termnals 15*b* and/or the counter-members 22*b*, which can be particularly appropriate for fully mechanized assembly by a robot. In this case the connecting piece 16*b* engages on the underside of the flange edge 5*b* or hotplate 1*b* and is substantially directly carried by the leads 14*b***.

Figure 5:
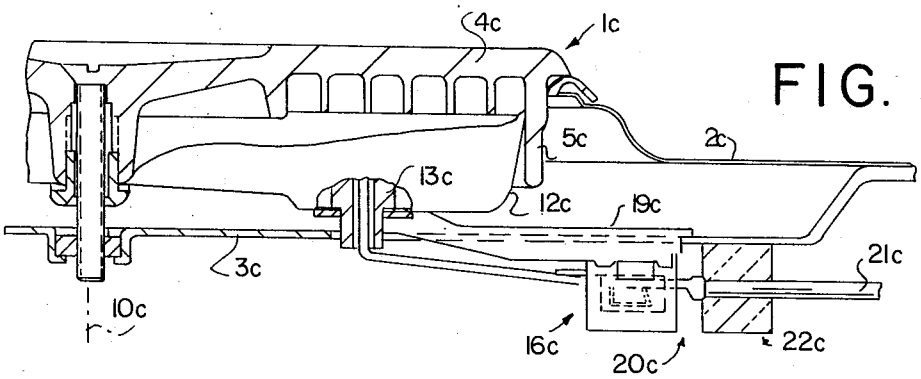
FIG. 5: Another embodiment in a representation corresponding to FIG. 1.

As is shown in FIG. 5, all the connecting lines **21*c* can be combined into a common mating plug 22*c*, which is appropriately fixed in position with respect to the mounting plate 2*c* on the underside of holding part 3*c* in the vicinity of the opening thereof in such a way that it bridges said opening. This mating plug 22*c* can be formed in simple manner in that the associated ends of the connecting lines 21*c* are fixed in an insulating casing in such a way that their multicore cable ends in parallel and juxtaposed with predetermined spacings project behind the side of the insulating casing facing central axis 10*c*. Holding part 3*c* is appropriately constructed in such a way that it or the marginal zones of its opening form a guide for the connecting piece 16*c* parallel to the plugging direction of the snap closure coupling 20*c* and which advantageously engages on support arm 19*c* and on inserting hotplate 1*c* in mounting plate 2*c* guides the connecting piece 16*c* in an oriented manner in such a way that it automatically comes into the predetermined plugging engagement with mating plug 22*c***. This type of plug connection construction is known, for example according to South African Pat. No. 86/6439 and can be advantageously used. Reference should be made thereto for further details and effects.

The cover-like holding part **3*c*, traversed in an opening by the lower end of insulating sleeve 13*c* and receiving the support arm 19*c* in laterally guided manner, is in this case located with its substantially planar bottom at a limited distance below the cove plate 12*c* or the hotplate body 4*c* and at the upper end of its circumferential surface surrounding flange edge 5 passes into an outwardly directed, ring disk-like edge, with which it is supported on the underside of mounting plate 2*c*** radially outside the protuberance having the plate opening.

Figure 6:
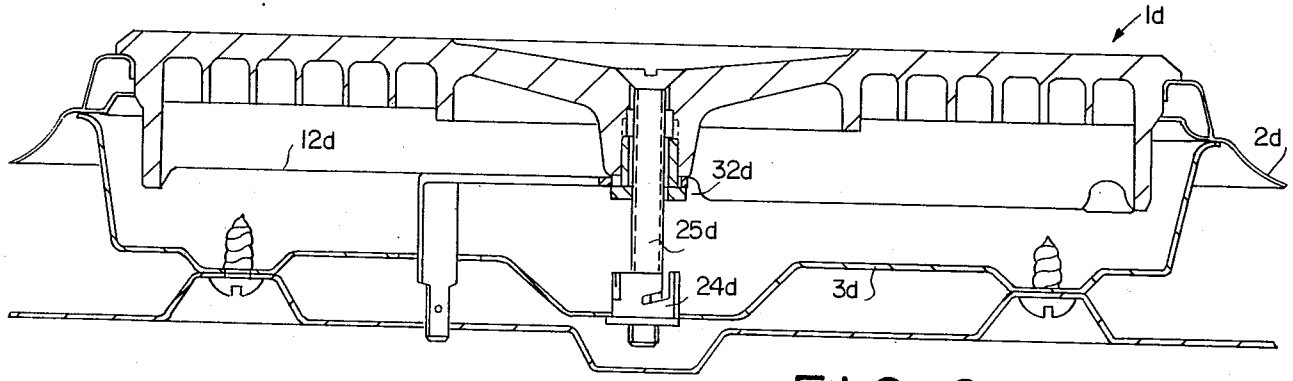
FIG. 6: Another electric hotplate in axial section and in the fitted state.

In the embodiment according to FIG. 6 there is also an easily detachable snap closure, e.g. a bayonet closure in the manner of a fast screw connection for connecting the fastening bolt **25*d* to the countermember 24*d* and for locking the hotplate 1*d* with less than one rotation of the fastening bolt 25*d*. The countermember 24*d* is constructed as a sleeve, which passes through the bottom of holding part 3*d* and is supported by a collar on its underside. In the sleeve casing are provided in rising manner slots for receiving pins, which project behind the outer circumference of the fastening bolt 25*d*. One end of the particular slot extends over an approximately axial insertion portion up to the upper end face of countermember 24*d*. Holding part 3*d* appropriately surrounds an empty cavity, but can also be used for receiving a heat insulating material, which substantially fills the space between the cover plate 12*d* and the holding part 3*d*. The washer for the securing sleeve 32*d* can also be formed by the fastening end of a grounding connecting lug, which according to FIG. 6 passes through the thermal insulation and projects downwards over the underside of the holding part 3*d*. In order, despite the throughbore, to ensure a complete, tightly closed top of the hotplate body 4, between head 26 of fastening bolt 25 and the associated hole portion, namely countersunk hole 27, can be provided a seal or a sealing material, which also secures the fastening bolt 25** against accidental loosening or detachment.

We claim:

1. An electric hotplate, comprising:

a hotplate body including means for mounting the hotplate body in a mounting plate by insertion from a plate top in the vicinity of a plate opening, said hotplate body having a cooking surface on a top side, an underside, and an outer circumference, the hotplate body defining a central axis;

at least one heating resistor for said hotplate body, and terminals for electrically connecting said at least one heating resistor to mating terminals of supply lines, said terminals projecting in the vicinity of said underside of the hotplate body and being provided with at least one electrical connecting piece of an electrical coupling means operable from said top of said mounting plate;

a central stud provided in the center of the hotplate body and projecting from said underside, said central stud having a bore for receiving a fastening bolt for locking the hotplate with respect to said mounting plate, said bore being constructed as a throughbore passing through the central stud and provided to receive said fastening bolt with a bolt head of said fastening bolt being countersunk with respect to the cooking surface and operable from the cooking surface, and wherein said terminals project substantially radially with respect to said central axis towards said outer circumference, thereby providing terminals constructed for connection to said mating terminals before inserting said hotplate in said plate opening, said terminals being constructed for bearing said mating terminals.

2. The hotplate according to claim 1, wherein at least two of said terminals are connected to a common connecting piece of said electrical coupling means, said connecting piece being located outside said outer circumference.

3. The hotplate according to claim 1, wherein said connecting piece is arranged in a substantially positionally stable manner on the hotplate, said connecting piece being provided at an end of a support arm located at the underside fo the hotplate and projecting beyond the outer circumference.

4. The hotplate according to claim 1, wherein said connecting piece is constructed as a plug part having at least one plug opening.

5. The hotplate according to claim 1, wherein a cover plate supported against an end face of said central stud is provided on said underside of said hotplate body, said cover plate being fixed with respect to said central stud with a securing sleeve engaging in the throughbore and constructed for being passed by said fastening bolt engaging said throughbore, said securing sleeve having a bore substantially equally adapted to a shaft of said fastening bolt, as said securing sleeve is adapted to the throughbore.

6. The hotplate according to claim 5, wherein said securing sleeve has a connecting member engaging substantially positively in an inner profiling of the throughbore, said securing sleeve having a sleeve part provided with an external thread engaging in an internal thread of said throughbore.

7. The hotplate according to claim 6, wherein said inner profiling extends only over part of a length extension of said throughbore, said inner profiling extending substantially directly from a lower end of said throughbore.

8. The hotplate according to claim 5, wherein said securing sleeve is formed by a component separate from said cover plate, said securing sleeve having a collar supported on an underside of said cover plate.

9. The hotplate acording to claim 1, wherein the throughbore has at least one of a narrower and a shorter bore portion as well as a wider bore portion extending substantially from a lower end of said central stud and being provided with an inner profiling.

10. The hotplate according to claim 9, wherein a width of said narrower bore portion of said throughbore and an internal width of said securing sleeve spaced from said narrower bore portion are substantially the same.

11. The hotplate according to claim 1, wherein an end portion of said throughbore associated with said cooking surface is constructed as a frustum-shaped countersunk hole adapted for a flush-countersunk reception of said bolt head of said fastening bolt, said bolt head being flush with a bottom face of a central flat depression provided in said cooking surface.

12. The hotplate according to claim 1, wherein said fastening bolt has a bayonet-closure pin for engaging in a counter member formed by a fast-action lock nut located below said hotplate.

13. The hotplate according to claim 1, wherein said fastening bolt has an external thread for engaging in a countermember formed by a fast-action lock nut located below said hotplate.

14. The hotplate according to claim 10 or 13, wherein a sheet metal holding part having said countermember and provided to be fixedly supported against said underside of said mounting plate is provided for arrangement below at least one of said hotplate and said mounting plate.

15. The hotplate according to claim 14, wherein said terminals are located entirely inside said holding part.

16. The hotplate according to claim 1, wherein said hotplate body is made from a cast material providing a substantially circular, planar and closed cooking surface having a depression on said top side within said cooking surface, said bolt head of said fastening bolt being located in said depression.

17. The hotplate according to claim 1, wherein connecting leads providing said terminals pass an insulating sleeve traversing a lower cover of said hotplate body, said connecting leads being bent directly below said insulating sleeve towards said outer circumference.

18. The hotplate according to claim 1, wherein said terminals are freely projecting individual terminals provided by bent connecting leads passing an insulating sleeve.

19. The hotplate according to claim 1, wherein said supply lines are inherently rigid insulated lines having extension portions resiliently extendable in a longitudinal direction.

20. An electric hotplate, comprising:

a hotplate body including means for mounting the hotplate body in a mounting plate by insertion from a plate top in the vicinity of a plate opening, said hotplate body having a cooking surface on a top side, an underside, and an outer circumference, the hotplate body defining a central axis;

at least one heating resistor for said hotplate body, and terminals for electrically connecting said at least one heating resistor to mating terminals of supply lines, said terminals projecting in the vicinity of said underside of the hotplate body and being provided with at least one electrical connecting piece of an electrical coupling means operable from said top of said mounting plate;

a central stud provided in the center of the hotplate body and projecting from said underside, said central stud having a bore for receiving a fastening bolt for locking the hotplate with respect to said mounting plate, said bore being constructed as a throughbore passing through the central stud and provided to receive said fastening bolt with a bolt head of said fastening bolt being countersunk with respect to the cooking surface and operable from the cooking surface, and wherein a mating plug for said terminals is fixed below said plate top on an underside of said mounting plate, means being provided for connecting said mating plug to said supply lines upon insertion of the hotplate into said plate opening of said mounting plate by way of an automatic plugging engagement with the mating plug, said terminals projecting substantially radially with respect to said central axis toward said outer circumference.

21. The hotplate according to claim 1 or 20, wherein a holding part for said hotplate has an opening with edges forming a guide for a leterally guided reception of at least one of a connecting piece and a support arm for said terminals, thereby providing means for oriented guiding of said connecting piece during insertion of said hotplate into said plate opening.

* * * * *